US005324939A

United States Patent [19]

Louris et al.

[11] Patent Number: 5,324,939

[45] Date of Patent: Jun. 28, 1994

[54] METHOD AND APPARATUS FOR EJECTING UNWANTED IONS IN AN ION TRAP MASS SPECTROMETER

[75] Inventors: John N. Louris; Dennis M. Taylor, both of Santa Clara County, Calif.

[73] Assignee: Finnigan Corporation, San Jose, Calif.

[21] Appl. No.: 68,915

[22] Filed: May 28, 1993

[51] Int. Cl.[5] ..... H01J 49/42

[52] U.S. Cl. ..... 250/292; 250/291

[58] Field of Search ..... 250/292, 291, 282

[56] References Cited

U.S. PATENT DOCUMENTS

| | | | |
|---|---|---|---|
| 4,761,545 | 8/1988 | Marshall et al. | 250/291 |
| 4,818,869 | 4/1989 | Weber-Grabau | 250/282 |
| 4,945,234 | 7/1990 | Goodman et al. | 250/291 |
| 5,013,912 | 5/1991 | Guan et al. | 250/282 |
| 5,107,109 | 4/1992 | Stafford, Jr. et al. | 250/282 |
| 5,134,286 | 7/1992 | Kelley | 250/282 |
| 5,248,882 | 9/1993 | Liang | 250/291 |

FOREIGN PATENT DOCUMENTS 0362432 4/1990 European Pat. Off. .

*Primary Examiner*—Jack I. Berman

*Attorney, Agent, or Firm*—Flehr, Hohbach, Test, Albritton & Herbert

[57] ABSTRACT

A method and apparatus is described which determines a plurality of spaced discrete frequencies covering the range of frequencies of the characteristic motion of unwanted ions and processes said discrete frequencies to generate a plurality of time dependent voltage amplitude values which vary throughout the time domain such that the frequency content of said plurality of time dependent voltage amplitude values is relatively uniform over the entire time domain, and such that the magnitude associated with the discrete frequencies is relatively uniform over the frequency domain.

26 Claims, 14 Drawing Sheets 100
100
3
ABUNDANCE, TOTAL (PER CENT)
ABUNDANCE, m/z 131 (PER CENT)
ABUNDANCE, m/z 132 (PER CENT)
195 190 185 180 175 170 165 160 155
NOTCH CENTER FREQUENCY, kHz

METHOD AND APPARATUS FOR EJECTING UNWANTED IONS IN AN ION TRAP MASS SPECTROMETER

BRIEF DESCRIPTION OF THE INVENTION

This invention relates to a method and apparatus for ejecting the ions in an ion trap mass spectrometer.

BACKGROUND OF THE INVENTION

Mass spectrometers are used to determine the chemical identity of substances by determining the mass of ions derived from the substances. The mass of an ion is determined by using the known behavior of charged particles in electric and magnetic fields, with some characteristic of the ion trajectory being observed and used to deduce the mass-to-charge ratio of the ion. Mass spectrometers may be divided into two broad classes: instruments that produce a beam of ions to effect mass analysis (such as magnetic sector spectrometers and quadrupole spectrometers) and instruments that trap a population of ions to effect mass analysis (such as ion cyclotron resonance mass spectrometers and Paul ion trap mass spectrometers).

The various types of mass spectrometers have advantages and disadvantages, and a large variety of instruments are now commercially available. No one type of instrument can deliver the necessary performance in all types of applications at an acceptable cost, and vigorous competition exists between the manufacturers of the various types of instruments to increase performance while controlling cost.

One disadvantage of trap-type mass spectrometers, either the Paul ion trap mass spectrometer or the ion cyclotron resonance mass spectrometer (ICR), is that the presence of the population of ions necessarily perturbs the electric field experienced by the ions, so that the ion trajectories depend on the number of ions present. This results in inaccuracy in the determination of m/z, because the field perturbation is quite complex, and the number of ions may change during mass analysis. The "space charge" introduced by the ions limits the number of ions that may be present during mass analysis if mass accuracy (and mass resolution) are to be maintained. For the Paul ion trap mass spectrometer, the practical effect of space charge is that the dynamic range (for purposes of mass analysis) is limited to about two orders of magnitude, because the more abundant ions "fill" the trap before the population of non-abundant ions is great enough to be detected with an adequate signal-to-noise ratio.

This limitation is most severe in those applications where the amount of analyte varies widely and unpredictably, such as in the gas chromatographic/mass spectrometric investigation of samples encountered in environmental analysis. Because of the costly high-field electromagnets needed for ion cyclotron resonance spectrometers, these instruments have seen little commercial use as detectors in chromatographic instruments for which the detector must be relatively inexpensive. In contrast, Paul ion trap mass spectrometers are now used almost exclusively as GC detectors, so the space charge limitation to dynamic range, although important to both types of spectrometer, is of more practical importance in Paul ion trap mass spectrometers.

An important development in the use of the Paul ion trap as a chromatographic detector was the dynamic control of the number of ions stored in the trap by adjusting the length of time during which ions are formed. U.S. Pat. No. 5,107,109 describes a method wherein a preliminary analysis is performed to estimate the rate of ion formation, and the actual mass analysis is then accomplished by using an ionization interval (calculated from the rate of ion formation) that gives a fixed, "target" number of ions in the trap. For well-separated chromatographic peaks, this dynamic control of the ionization time can extend the dynamic range so that analytes of concentrations varying by as much as five orders of magnitude can be successfully mass-analyzed. However, if the compounds are not chromatographically resolved, dynamic control of the ionization time will allow the acquisition of the mass spectrum of the mixture of the two compounds, but the internal dynamic range of the mass spectrum is limited to two orders of magnitude, and the less abundant compound may not be observed at all.

Another method of controlling the extent of space charge is the selective exclusion of ions from the trap, either during or after the formation of ions. From the time of the first commercial introduction of the Paul ion trap mass spectrometer, the r.f. voltage during ionization was adjusted so that certain low-mass ions (from air, water, etc.) would not be stored during ionization. Dawson and coworkers used a combined DC and r.f. field during ionization that allowed only a narrow mass range to be stored. March and coworkers (M. A. Armitage, J. E. Fulford, D. -N. Hoa, R. J. Hughes and R. E. March, "The Application of Resonant Ion Ejection to Quadrupole Ion Storage Mass Spectrometry: A Study of Ion/Molecule Reactions in the QUISTOR," 1979, *Can. J. Chem.*, vol. 57, pp. 2108–2113) used resonance ejection to selectively eliminate ions from the trap. Use of alternating steps of ionization and ejection of undesired ions through the use of a DC field is described by Weber-Grabau (U.S. Pat. No. 4,818,869). Franzen et al. (European patent application, publication 0362432) describe the use of broadband waveforms for the resonance ejection of undesired ions during ionization.

The use of broadband waveforms for the ejection of ions from the ion cyclotron resonance trap is well established, although this has mostly been done for purposes other than simply controlling space charge, such as ion isolation prior to an ms/ms experiment. The early workers used noise waveforms (generated by analog methods) for ion ejection, but Marshall et al. (U.S. Pat. No. 4,761,545) describe calculated waveforms tailored to the particular experiment. In Marshall et al., a table of numbers is stored in a digital memory and these points are sequentially converted to an analog voltage by a digital-to-analog converter and associated electronic circuits. The "arbitrary waveform" was calculated by Marshall et al. by first choosing the desired frequency spectrum of the waveform and then using the inverse Fourier transform to calculate the waveform having the desired frequency spectrum. This technique of calculating a waveform using the inverse Fourier transform (inverse FT or FFT for "fast Fourier transform") and then creating the waveform by successively converting to analog form the digital values in a stored table is called the SWIFT method (for Stored Waveform Inverse Fourier Transform).

Formally, the Fourier transform maps a complex function to a complex function. Practically, a waveform is a pure real function (amplitude as a function of time)

which is called the "time domain", and the Fourier transform maps this to a complex function (a complex quantity as a function of frequency) which is called the "frequency domain". The inverse Fourier transform maps the complex function to the time domain and the discrete inverse Fourier transform (used for numerical computation) acts on an array of complex data. Each point in the array may be described using the cartesian representation (with a real and an imaginary part) or equivalently by using the polar representation (with a magnitude and a phase part), but algorithms for calculating the forward and inverse discrete Fourier transform generally use the cartesian representation. The polar representation has the advantage that the magnitude and phase parts are closely related to the familiar parameters of simple cosine waves: the magnitude part of the frequency spectrum at a particular frequency corresponds to the amplitude of the cosine function associated with that frequency, and the phase part of the frequency spectrum at that frequency corresponds to the phase of the cosine function. For a particular application of Marshall's method, the magnitude part of the frequency spectrum is assigned according to the efficiency with which ions are to be ejected; in a typical application the magnitude would be a constant for those frequencies associated with ions that are to be ejected, the magnitude would be zero for some range of frequencies associated with ions that are to be retained within the cell, and the magnitude would likewise be zero for frequencies outside the range of possible ion frequencies.

The phase part of the frequency spectrum is more difficult to assign, because there is no single, simple criterion that unambiguously leads to a phase assignment. For a given assignment of the magnitude part of the frequency spectrum, each possible assignment of the phase part of the frequency spectrum governs the time course of the resulting time domain waveform that results from the inverse Fourier transform. Marshall et al. noted that for the simple, useful magnitude assignment in which the magnitude is everywhere zero, except for a range of frequencies at which it is constant, the simplest conceivable phase assignment of zero at all frequencies results in a time domain waveform that is essentially a very narrow pulse. These workers rejected this phase assignment because the high amplitude during the pulse results in the need for excessive dynamic range in both the analog and digital parts of the electronic hardware needed to produce the waveform. They recommended the assignment of the phase as a quadratic function of the frequency; the resulting time domain waveform is not pulse-like, but has the power distributed throughout the time period so that the dynamic range requirements of the electronics are much less demanding. More recently, Goodman et al. (U.S. Pat. No. 4,945,234) and Guan et al. (U.S. Pat. No. 5,013,912) have further developed methods for assigning the phase part of the frequency spectrum.

That the ion motions in ICR traps and Paul traps share enough characteristics that the waveforms used for ion ejection are much the same in both instruments has been recognized since the work of Marshall et al., who described the SWIFT technique for both traps. In the ICR trap the ion trajectories are circular, but the excitation voltage is applied between opposing plates and the motion in the coordinate normal to the plates is sinusoidal, with the frequency of the motion being inversely proportional to the m/z of the ion. In the Paul trap, the excitation voltage is applied between the two end cap electrodes, while the ion motion is a reciprocating motion between the two electrodes. Over a large range of useful operating conditions the reciprocating motion may be approximated as being sinusoidal, with a frequency that is inversely proportional to the m/z of the ion. For both traps (within the limits of this approximation), the response of the ions to an excitation voltage is described by the linear, inhomogeneous differential equation commonly described as the equation of forced harmonic motion. Thus, much the same waveforms may be used in both Paul traps and ICR traps, and theoretical as well as practical considerations are shared in the development of waveforms for the two types of instrument. Guan and Marshall have described in some detail the relationship between the theories of ion ejection in the Paul trap and the ICR trap (Anal. Chem. 65, 1288–1294 (1993)).

Recently Kelley described the use of noise waveforms for the isolation of ions of a narrow mass range in the Paul ion trap (U.S. Pat. No. 5,134,286). He described the application of a frequency band-reject filter to a noise waveform so that the resulting waveform would cause all ions with resonant frequencies other than those within a specified band to be ejected from the trap. Kelley did not specify whether the noise waveform was created with an analog noise generator or with a digital arbitrary waveform generator.

When attempting to apply the previously described methods (e.g. the methods of Marshall, Franzen and Kelley) to the problem of selectively ejecting ions during the ionization stage in a Paul trap, we found serious limitations in all the calculated waveforms. The important problem of excluding ions from the Paul trap during the ionization interval has not previously been adequately investigated. In ICR spectrometry, the ion exclusion has generally been performed after ionization. The requirements imposed on such waveforms are less stringent than those that are needed of waveforms that exclude ions during ionization; in particular, the frequency content of the waveform must stay uniform throughout the ionization period because ions are formed throughout the ionization period. For example, a linear scan (or at least a monotonic scan) of the resonance ejection frequency is commonly used to exclude ions from an ICR cell, but such a waveform would not be suitable for ejection during ionization, because ions created after the frequency has swept past the resonance frequency would not be ejected.

OBJECTS AND SUMMARY OF THE INVENTION

It is a general object of this invention to provide a method and apparatus for calculating a time domain waveform to use as an excitation signal for selectively ejecting ions from a Paul ion trap or an ICR trap mass spectrometer.

It is another object of this invention to provide a method and apparatus for providing an ion ejection waveform that is relatively uniform in frequency content throughout the entire time domain so that ions are ejected according to their resonant frequency without regard to when in the time domain they are formed or introduced into the trap.

It is another object of this invention to provide a method and apparatus for selectively ejecting a range of ions while retaining others.

It is another object of this invention to provide a method and apparatus for isolating an ion or a selected group of ions in an ion trap.

The foregoing and other objects of the invention are achieved by a method and apparatus for ejecting unwanted ions formed in or introduced into an ion trap which traps ions over a predetermined mass range to leave a higher concentration of wanted ions. Said method and apparatus determines a plurality of spaced discrete frequencies covering the range of frequencies of the characteristic motion of unwanted ions and processes said discrete frequencies to generate a plurality of time dependent voltage amplitude values which vary throughout the time domain such that the frequency content of said plurality of time dependent voltage amplitude values is relatively uniform over the entire time domain, and such that the magnitude associated with the discrete frequencies is relatively uniform over the frequency domain.

BRIEF DESCRIPTION OF THE DRAWINGS

Operation of an ion trap to achieve the above and other objects of the invention will be clearly understood when the following description is read in conjunction with the accompanying drawings of which:

FIG. 14 shows three ejection efficiency frequency spectra obtained using a waveform calculated according to the invention. Unlike the ejection efficiency frequency spectra of the preceding figures, the waveform was applied during ionization so that ions with a range of m/z values were present during application of the waveform.

DESCRIPTION OF PREFERRED EMBODIMENT

Figure 1:
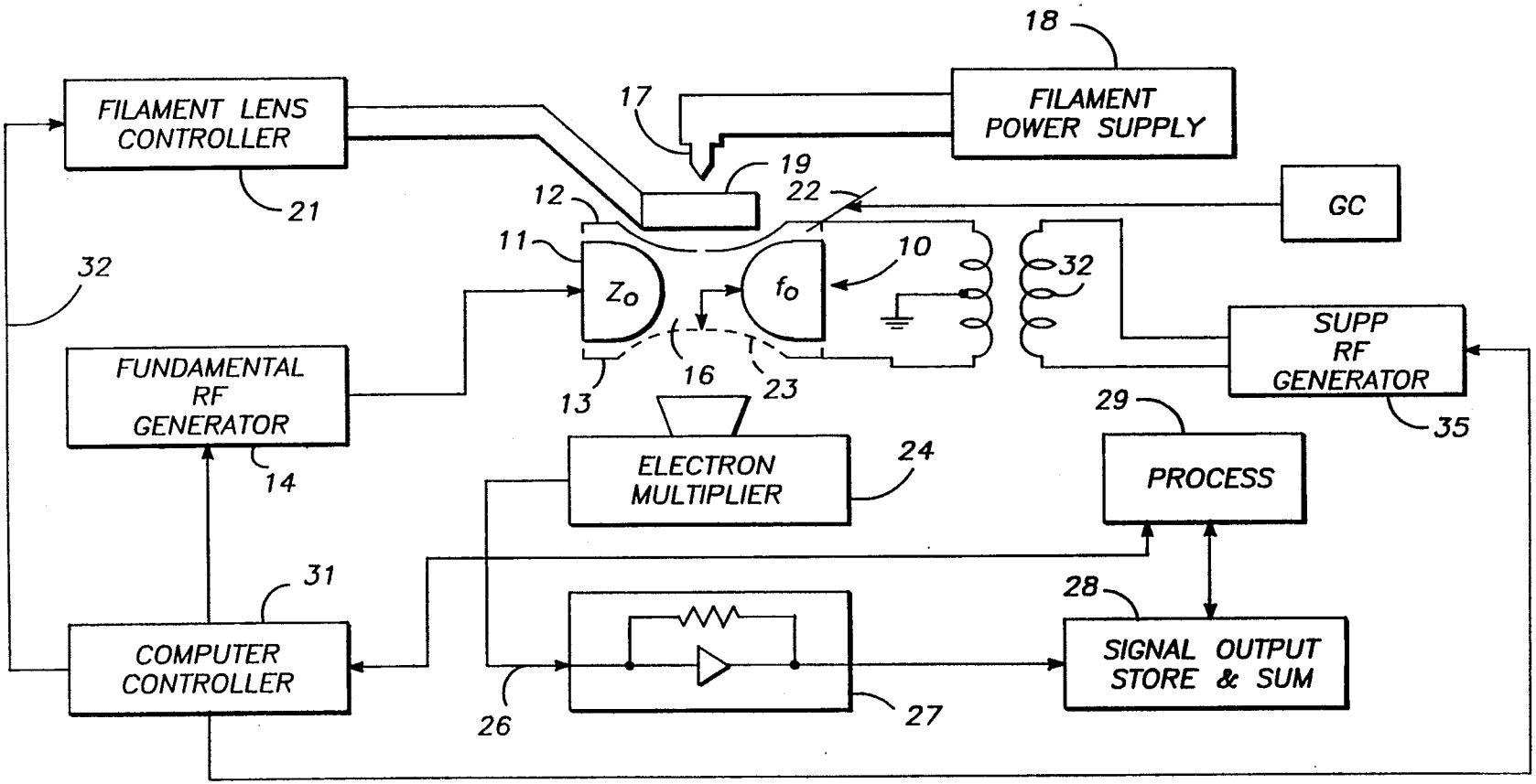
FIG. 1 is a simplified schematic of a quadrupole ion trap mass spectrometer along with a block diagram of associated electrical circuits for operating the mass spectrometer in accordance with the invention.

There is shown in FIG. 1 at 10 a three-dimensional ion trap which includes a ring electrode 11 and two end caps 12 and 13 facing each other. A radio frequency voltage generator 14 is connected to the ring electrode 11 to supply an r.f. voltage V sin $\omega t$ (the fundamental voltage) between the end caps and the ring electrode which provides a substantially quadrupole field for trapping ions within the ion storage region or volume 16. The field required for trapping is formed by coupling the r.f. voltage between the ring electrode 11 and the two end-cap electrodes 12 and 13 which are common mode grounded through coupling transformer 32 as shown. A supplementary r.f. generator 35 is coupled to the end caps 22, 23 to supply a radio frequency voltage between the end caps; this r.f. generator produces an arbitrary waveform by sequentially reading a table of internally stored values and converting them to analog voltages via a digital-to-analog convertor. The supplementary r.f. generator 35 is capable of producing different waveforms at different times during the scan sequence so that, for example, a complex waveform may be produced during the ionization interval and later in the scan sequence (during the mass analysis period) a simple sinusoidal waveform may be produced (as described by Syka et al., U.S. Pat. No. Re. 34,000). The table of stored values is computed by an external computer and loaded into the digital memory of the r.f. generator. A filament 17 which is fed by a filament power supply 18 is disposed which can provide an ionizing electron beam for ionizing the sample molecules introduced into the ion storage region 16. A cylindrical gate lens 19 is powered by a filament lens controller 21. This lens gates the electron beam on and off as desired. End cap 12 includes an aperture through which the electron beam projects.

Rather than forming the ions by ionizing sample within the trap region 16 with an electron beam, ions can be formed externally of the trap and injected into the trap by a mechanism similar to that used to inject electrons. In FIG. 1, therefore, the external source of ions would replace the filament 17 and ions, instead of electrons, are gated into the trap volume 16 by the gate lens 19. The appropriate potential and polarity are used on gate lens 19 in order to focus ions through the aperture in end-cap 12 and into the trap. The external ionization source can employ, for example, electron ionization, chemical ionization, cesium ion desorption, laser desorption, electrospray, thermospray ionization, particle beam, and any other type of ion source.

The opposite end cap 13 is perforated 23 to allow unstable ions in the fields of the ion trap to exit and be detected by an electron multiplier 24 which generates an ion signal on line 26. An electrometer 27 converts the signal on line 26 from current to voltage. The signal is summed and stored by the unit 28 and processed in unit 29.

Controller 31 is connected to the fundamental r.f. generator 14 to allow the magnitude and/or frequency of the fundamental r.f. voltage to be scanned to bring successive ions towards resonance with the supplementary field applied across the end caps for providing mass selection. The controller 31 is also connected to the supplementary r.f. generator 35 to allow the triggering of the arbitrary waveform at the appropriate period in the scan function. The controller on line 32 is connected to the filament lens controller 21 to gate into the trap the ionizing electron beams or an externally formed ion beam only at time periods other than the scanning interval. Mechanical details of ion traps have been shown, for example, U.S. Pat. No. 2,939,952 and more recently in U.S. Pat. No. 4,540,884 assigned to the present assignee.

In the SWIFT technique of Marshall et al. (U.S. Pat. No. 4,761,545) the waveform is computed using the inverse Fourier transform on an assigned array of phase and magnitude information. The desired frequency array is readily specified from the known frequency spectrum of ions within the trap, but the associated phase array is not so readily assigned. The simplest assignment for the phase array, a constant phase at all frequencies, yields a waveform from the inverse FT that is essentially a pulse. In practice, the necessarily limited electronic dynamic range (of the electronic amplifiers and the digital-to-analog converter) prohibits adequate physical realization of this type of waveform. Marshall teaches the use of a non-linear, continuous variation of the phase with frequency, and he describes the use of a quadratic function in sufficient detail that one may use the procedure to calculate such a waveform.

Figure 2A:
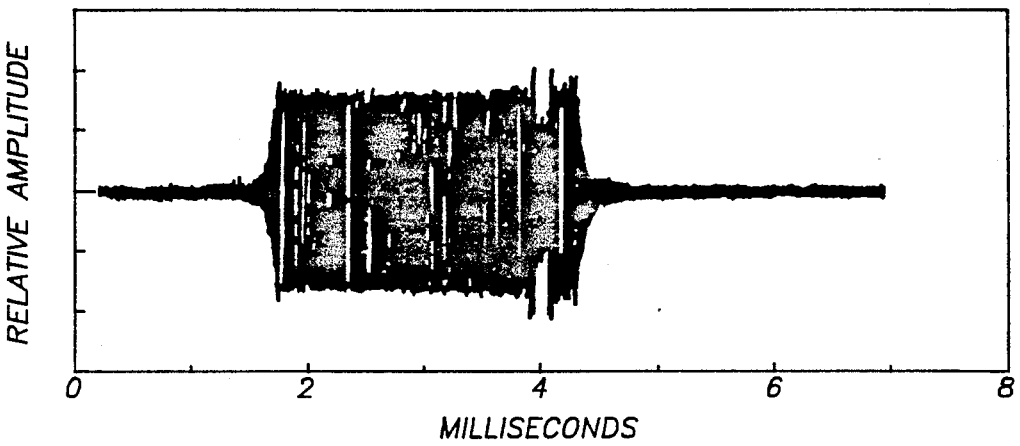
FIG. 2 shows the time domain calculated by SWIFT (FIG. 2*a*) from the magnitude part of the frequency domain shown (FIG. 2*b*) using a quadratic variation of the phase part of the frequency domain determined according to Marshall et al. The Figure was prepared by recording the waveform created by the apparatus of FIG. 1 using a digital oscilloscope, and determining the magnitude part of the frequency spectrum by an FFT of the observed time domain. The observed magnitude spectrum and the observed time domain are similar in essential aspects to the assigned magnitude spectrum and the calculated time domain.
Figure 2B:
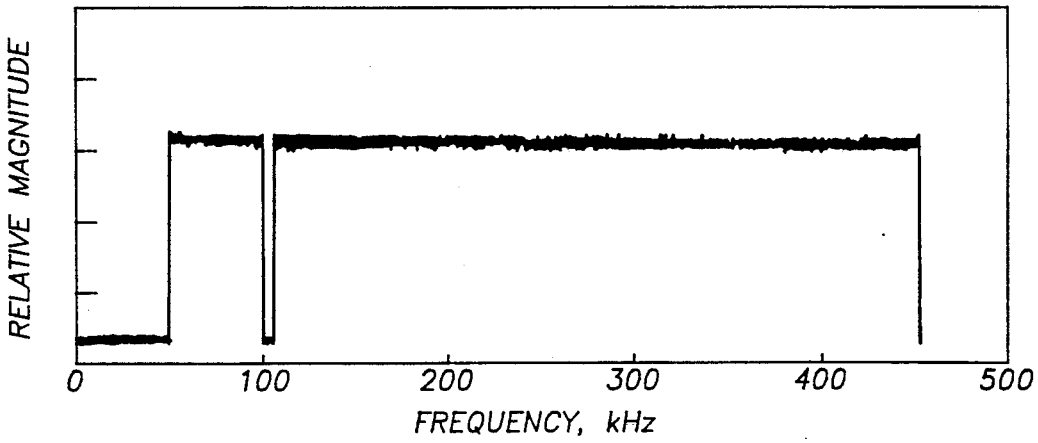
Figure 3A:
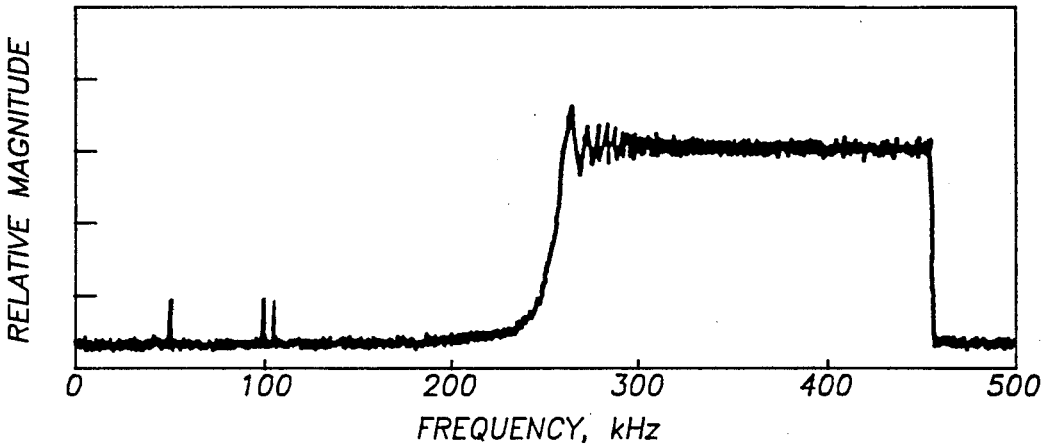
FIG. 3 shows a variation on the experiment shown in FIG. 2 in which the second half of the time domain is removed (FIG. 3*a*) and in which the first half of the time domain is removed (FIG. 3*b*) by electronically gating the waveform to zero during half of the time domain period.
Figure 3B:
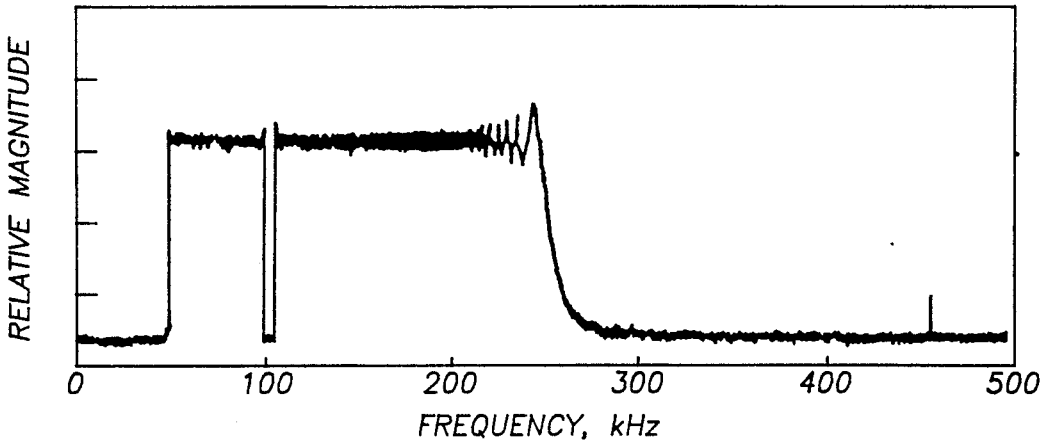

As shown by Marshall, such SWIFT waveforms are not pulses, but have an associated power that is distributed relatively evenly throughout the waveform. However, such waveforms are essentially frequency scans, as can be seen by performing a spectral analyses of time windows within the waveform. For example, FIG. 2 shows the time domain calculated by SWIFT (FIG. 2*a*) from the magnitude part of the frequency domain shown (FIG. 2*b*) using a quadratic variation of the phase part of the frequency domain determined according to Marshall et al. This figure was prepared by recording the waveform created by the apparatus of FIG. 1 using a digital oscilloscope, and determining the magnitude part of the frequency spectrum by an FFT of the observed time domain. The observed magnitude spectrum and the observed time domain are similar in essential aspects to the assigned magnitude spectrum and the calculated time domain. A spectral analysis of the first half of the waveform of FIG. 2 is shown in FIG. 3*a* and a spectral analysis of the second half of the waveform of FIG. 2 is shown in FIG. 3*b*. These spectral analyses of parts of the waveform were accomplished by electronically gating the waveform to zero, except during the time window of interest; the frequency spectra were obtained as in FIG. 2, by recording the waveform with a digital oscilloscope and performing an FFT on the resulting data. Other spectral analyses of smaller fractions of the waveform of FIG. 2 show that the time domain waveform is essentially a frequency scan in which the frequency content is localized in time and varies systematically during the time course of the experiment. This is further illustrated by noting the dip in amplitude in FIG. 2*a* that appears in the time domain (at about 4 ms) as the frequency scan reaches the frequency notch at 100 kHz.

Before the introduction of the SWIFT method to ICR spectrometry, ion ejection was frequently accomplished using electronic hardware that produced a frequency-swept waveform. Thus to Marshall et al., the frequency-sweep character of the SWIFT waveforms (calculated with a quadratic phase variation) was not important because the SWIFT technique enhanced the existing method: the SWIFT method gives much better control of the frequency spectrum of the waveform than can be obtained by simply creating a frequency scanned waveform and creating notches by filtering the waveform (either digitally or with analog electronics). However, for experiments in which the waveform is applied during ionization, waveforms in which the frequency content varies systematically with time are unsuitable. For example, if the waveform of FIG. 2 were used during ionization, ions formed at a later time than 4 ms (when the notch appears) would not experience the notch at all. The characteristic of a systematic variation in time or a constancy in time of the frequency content of a waveform will be called here the "temporal spectral homogeneity" of the waveform. Thus the waveform of FIG. 2 shows poor temporal spectral homogeneity.

Kelley U.S. Pat. No. 5,134,286 teaches the use of a filtered noise waveform for excluding ions from the Paul ion trap. We attempted to follow the method of this inventor, although he did not precisely describe what he meant by noise, so that his method is not specified as unambiguously as the method of Marshall et al. We calculated a noise waveform by using a random number generator with a gaussian distribution, so that the amplitude of the voltage produced by the system shows a gaussian distribution. Similarly, waveforms were calculated using a "uniform" distribution in which the digital value to be converted by the digital-to-analog convertor was equally likely to be any value within its range, as contrasted with the gaussian waveforms in which the digital values are statistically more likely to be closer to zero than to the extremes of the range. These waveforms were then typically filtered (using a frequency domain Fourier transform filter) to limit the bandwidth and to tailor the frequency spectrum to cause the ejection of some ions and permit the trapping of others.

Spectral analysis of the noise waveforms showed, as anticipated, little or no systematic variation of the frequency content over the course of the waveform (good temporal spectral homogeneity), but did show a regrettable tendency to be uneven in "spectral coverage", wherein certain frequencies are absent while other frequencies are especially abundant. The smaller the time window used for the spectral analysis, the more uneven was the spectral coverage. Thus, in comparison to the SWIFT experiments of FIG. 3 in which the frequency of the waveform varies smoothly with time, the frequency content of the noise waveform is distributed randomly throughout the time domain. For small time intervals, a particular frequency may not be present because of statistical variation. The use of such a waveform for ion ejection would tend to eject certain ions with good efficiency while other ions would not be adequately removed because of an unexpected "hole" in the frequency spectrum. In particular, an ion created late in the time course of the waveform may or may not be ejected, depending on the frequency of the ion motion and the vagaries of the frequency spectrum of the waveform. A higher average power for the entire waveform will tend to minimize the effect of such holes, but higher power also tends to limit the resolution of the ion ejection because ions are excited at frequencies other than their precise resonance frequency, with the effect decreasing at frequencies farther from the resonance frequency and increasing with increasing excitation voltage (power).

In practice, when one attempts to exclude undesired ions from the Paul trap using these noise waveforms, the power level for the entire waveform (the voltage gain of the amplifier between the digital-to-analog convertor and the trap electrodes) is adjusted so that ions of masses that are intended to be trapped do indeed remain trapped, while ions of masses just outside the mass window are indeed ejected. This results in a power level that is just sufficient for ion ejection of ions of masses just outside the notch, but the marginal power level that yields optimum mass ejection resolution also permits ions to be retained in the trap if their resonance frequency falls in a hole in the frequency spectrum of the waveform (because of poor spectral coverage).

Determining whether a waveform shows good spectral coverage is somewhat more complicated than determining whether a waveform shows good temporal spectral homogeneity. The latter determination can be readily made by examining the time course of the frequency spectra for windows of the waveform as described above, to determine whether the frequency content varies systematically during the waveform. A preliminary assessment of spectral coverage may also be made by observing the Fourier transform of the waveform (or a part of the waveform), but the frequency spectrum may be misleading about the actual ejection characteristics of a particular waveform: ions respond to excitation from frequency components other than that of their precise resonance frequency, and the relative intensities and phases of these nearby excitations interact in such a complex way that the ejection efficiency is not obvious from the frequency spectrum.

For this reason an actual measurement of the ejection efficiency gives a more realistic picture of the spectral coverage. The observation of the mass spectrum of ions that survive excitation with the waveform is, of course, one type of measurement of the spectral coverage. However, such a spectrum is difficult to interpret because it depends on the mass spectrum of the ions present in the trap before the application of the excitation waveform, and this mass spectrum may happen to lack ions with resonance frequencies near features of interest in the frequency spectrum. For the Paul trap, a more detailed view of the spectral coverage may be obtained by observing the fraction of ions of a particular m/z value that are not ejected by the waveform for a series of different r.f. trapping voltages (which give a particular ion different resonance frequencies). For example, the following experiment may be performed: ions are created by electron impact, a particular ion is isolated (by various field manipulations), the r.f. voltage is adjusted to a particular value, the waveform is applied between the end electrodes of the trap, and a mass analysis scan is performed so that the abundance of the ions remaining in the trap can be determined. A plot of such abundances as a function of the ion resonance frequency gives the actual ejection efficiency.

An alternate procedure is to use a constant r.f. trapping voltage, but to adjust the waveform itself. With a digital waveform generator, a "clock" determines the rate at which points are fetched from memory and converted to an analog voltage by the digital-to-analog convertor. If a waveform is calculated assuming some particular clock rate but the waveform is physically realized using some other clock rate, then all frequencies in the computed frequency spectrum of the waveform will be present in the actual waveform at a frequency scaled by the ratio of the real clock rate to the clock rate used for the calculation. Thus one may perform a series of experiments in which the r.f. level during ejection remains constant, but different clock rates are used so that different parts of the computed frequency spectrum actually effect ejection.

Figure 4:
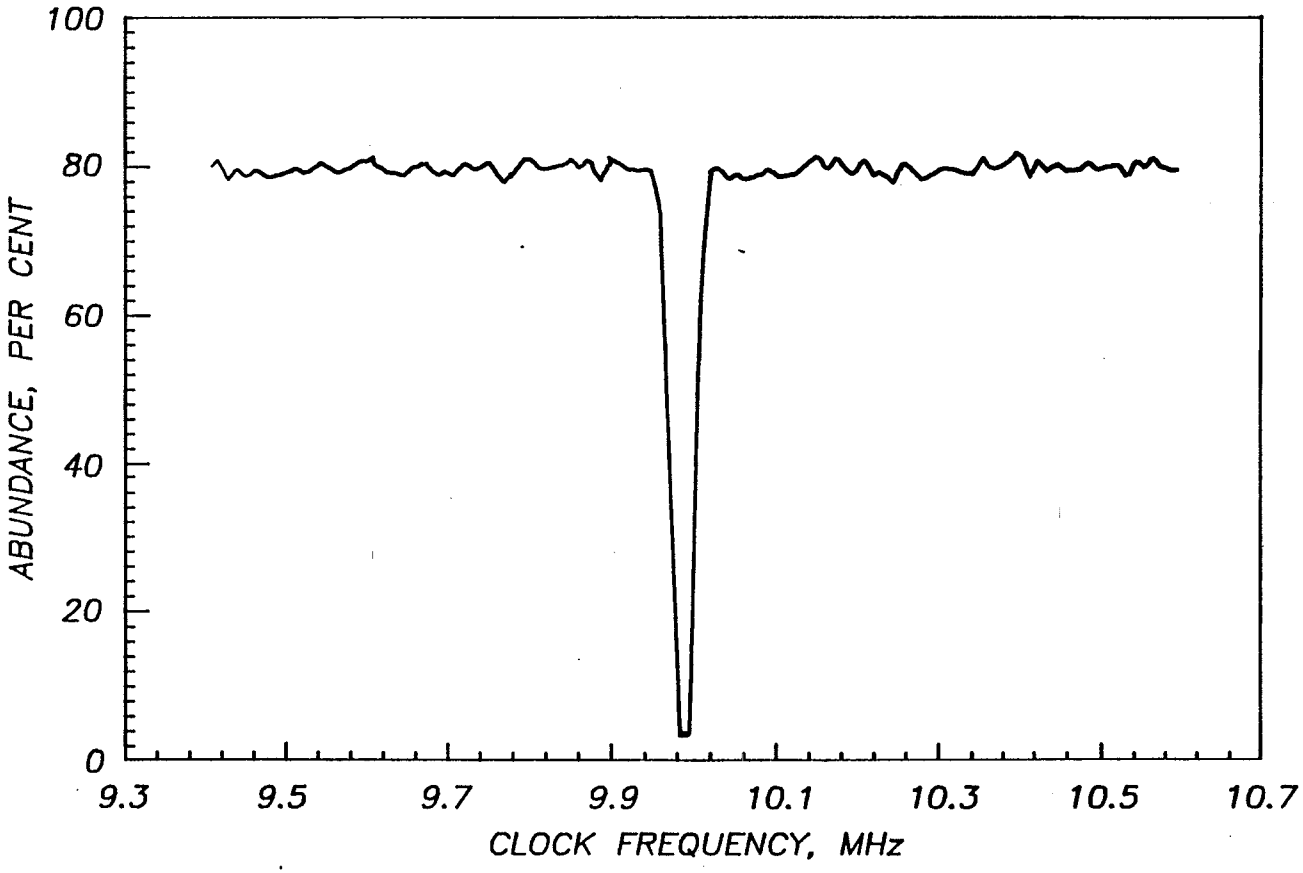
FIG. 4 shows the result of an experiment in which a waveform of a pure sine function was calculated assuming a frequency of 175.4 kHz and a clock rate of 10 MHz (131072 points). The actual clock frequency used to output the waveform from the arbitrary waveform generator was slowly varied from 9.4 MHz to 10.6 MHz so that the actual frequency spectrum produced by the waveform also varies.
Figure 5:
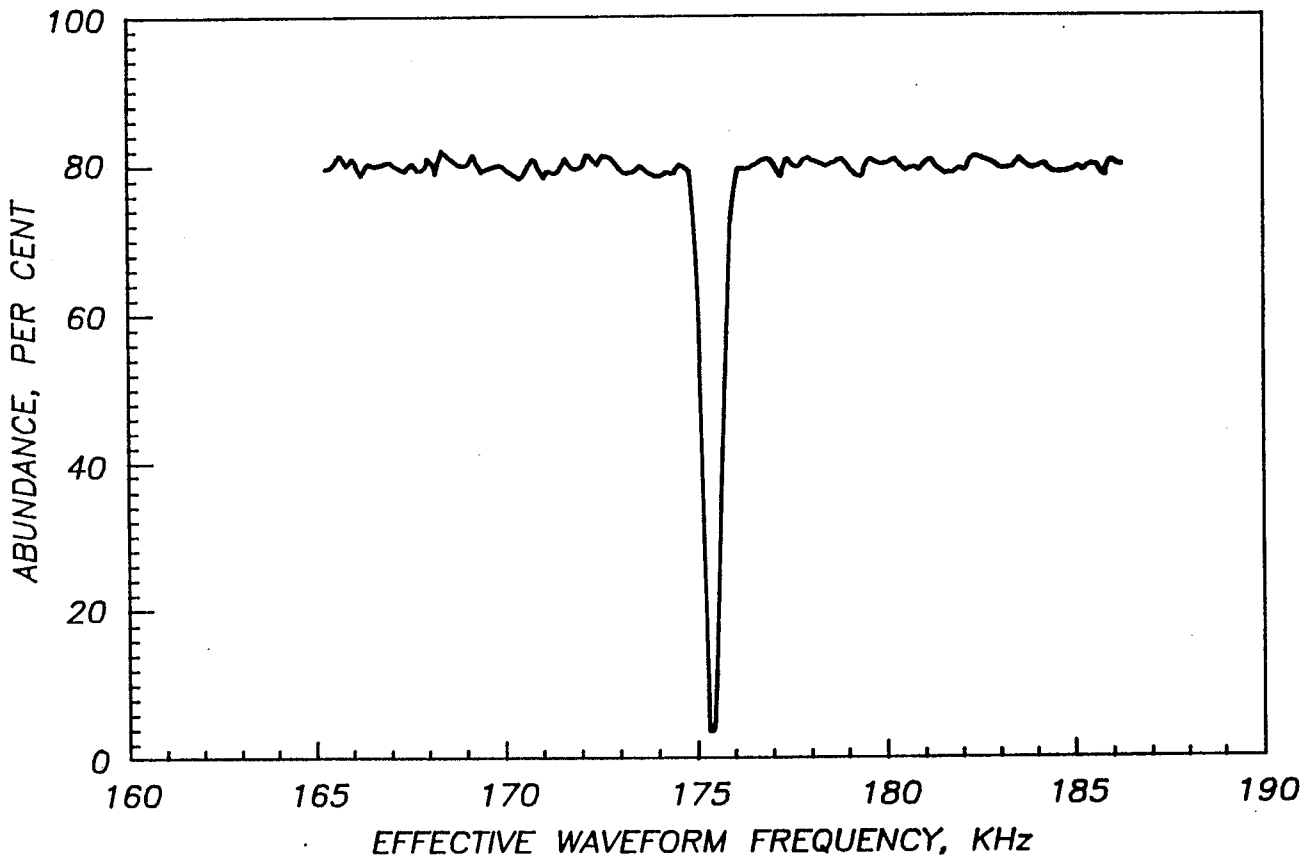
FIG. 5 shows the same data as FIG. 4, but with the abscissa plotted as the waveform frequency produced by the waveform; such a presentation is called here an "ejection efficiency frequency spectrum."

FIG. 4 shows the result of this type of experiment in which a pure sine function was calculated assuming a frequency of 175.4 kHz and a clock rate of 10 MHz (131072 points for a duration of 13.1 ms). The r.f. level during the ejection step of the experiment was chosen so that the resonance frequency of the ion of interest (m/z 414 from perfluoro-tri-n-butylamine) was close to 175.4 kHz. All other ions were ejected from the trap before the waveform was applied (to avoid confusion from space charge effects). This frequency was chosen to be close to the resonance frequency of this ion when stored at this r.f. level. This figure is a plot of the abundance of ions that survive the excitation from the waveform as a function of the clock rate of the waveform, but the purpose of the experiment is to obtain information about the waveform itself. Only one ion with one resonance frequency is ejected from the trap, but one may present the data as the ejection efficiency as a function of the frequency of the waveform when created at a clock rate of 10 MHz. For example, when the clock rate is 9.4 MHz, the ion will be responding to the part of the waveform that would appear at 186.6 kHz in the 10 MHz waveform (10 MHz/9.4 MHz×175.4 kHz) and when the clock rate is 10.6 MHz, the ion will be responding to the part of the waveform that would appear at 165.5 kHz. FIG. 5 is a plot of the abundance of the ions that survive the excitation waveform as a function of this "effective waveform frequency". This type of plot will be called the "ejection efficiency frequency spectrum" of the waveform used for ejection.

Figure 6:
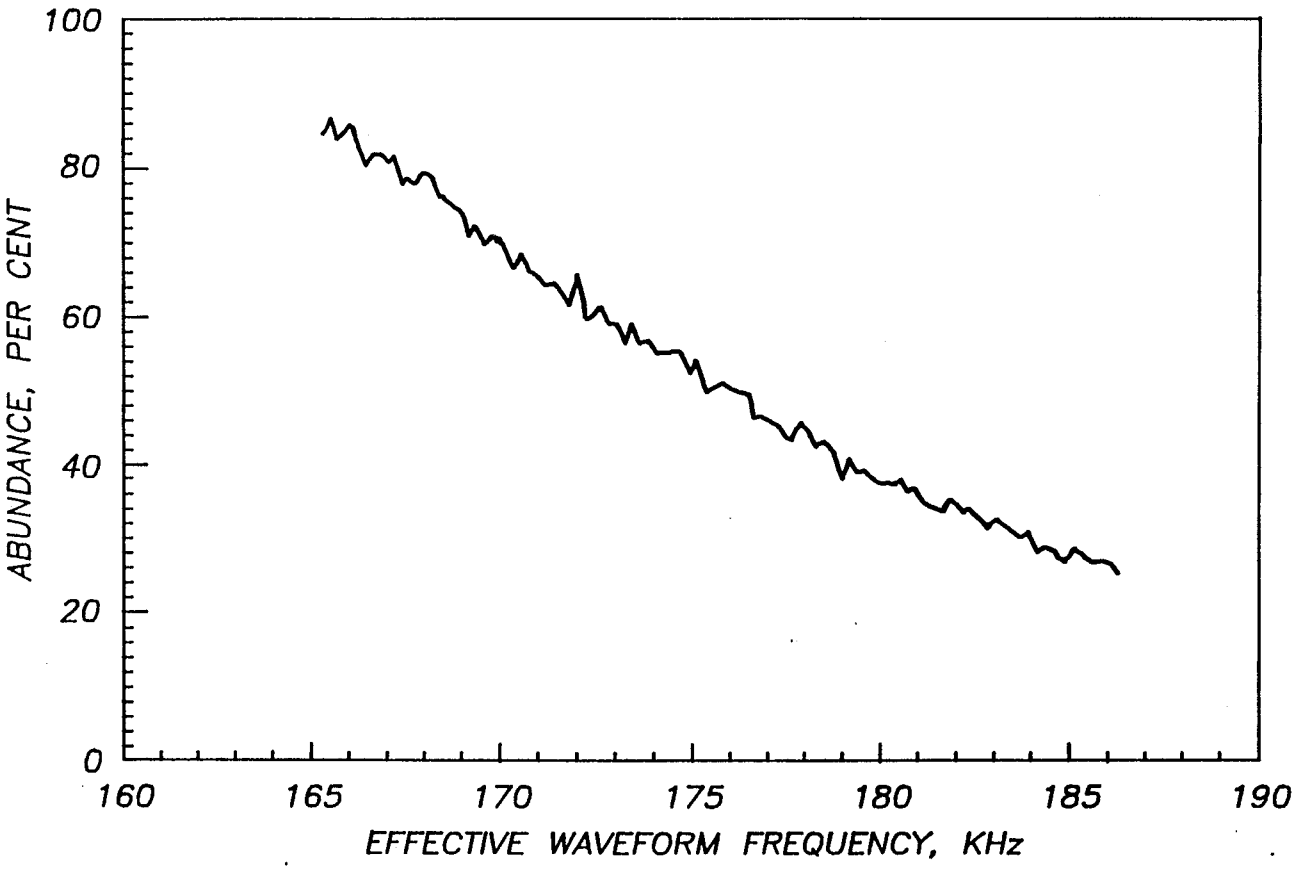
FIG. 6 shows an ejection efficiency frequency spectrum obtained with a SWIFT waveform calculated according to Marshall with a quadratic variation of the phase part of the frequency spectrum.

FIG. 6 shows an ejection efficiency frequency spectrum obtained with a SWIFT waveform calculated according to Marshall (131072 points with a quadratic variation of the phase spectrum). All frequencies throughout the range of 165.5 kHz to 186.6 kHz are effective at ejecting ions, and no extreme variation in the efficiency of ejection is evident(i.e., there is good spectral coverage). One notable characteristic of this spectrum is the decrease in abundance as the effective waveform frequency increases. This is due to a change in the spectral power density as the clock rate decreases; the same amount of power is compressed into a narrower bandwidth, and the ions respond to the power level within a band of frequencies. The general trend in the ejection efficiency spectrum is therefore more a result of the way the spectrum is acquired than a characteristic of the waveform. The effect is exaggerated by the selection of a waveform voltage that is close to the minimum voltage that can cause ejection, but that is also the voltage that results in maximum ejection resolution.

Figure 7:
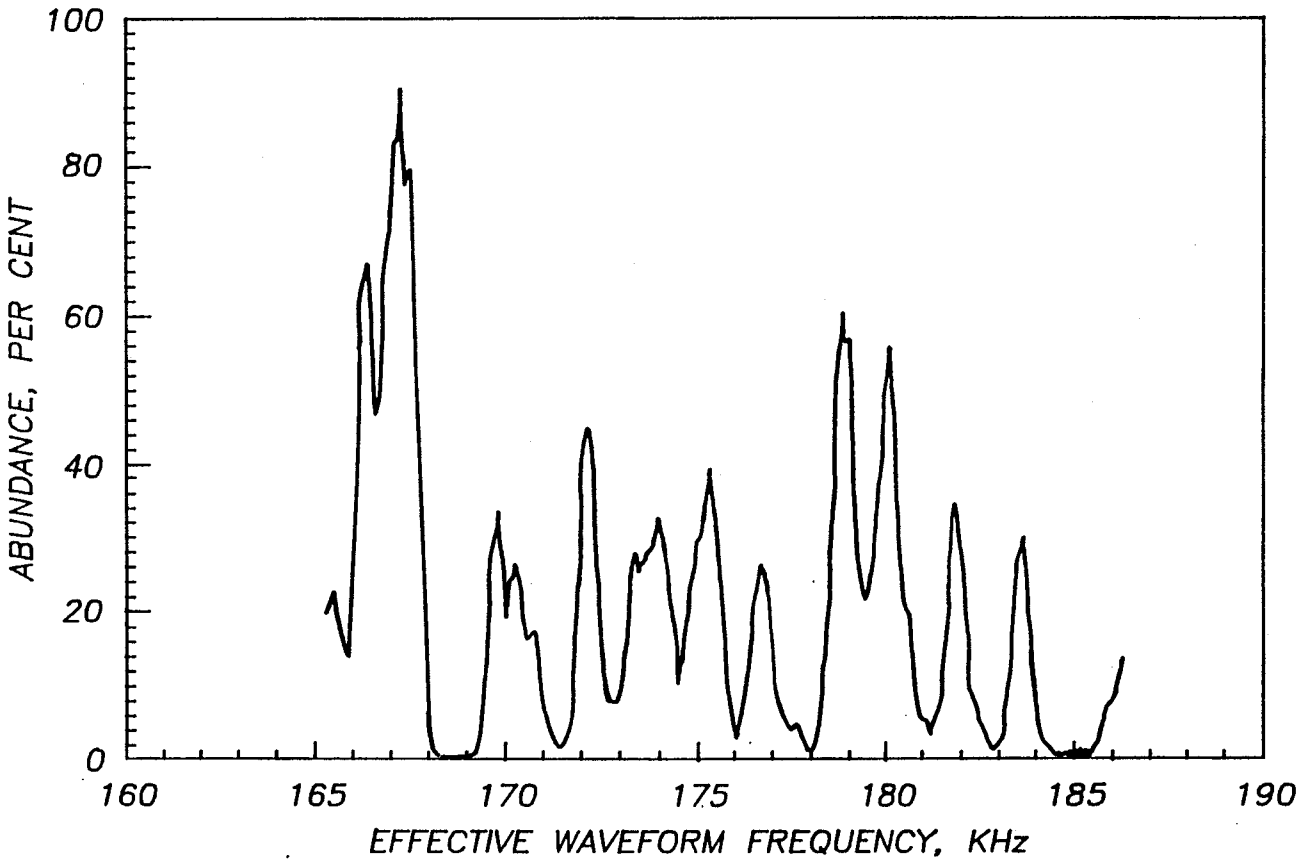
FIG. 7 is an ejection efficiency frequency spectrum obtained with noise waveforms according to Kelley U.S. Pat. No. 5,134,286.
Figure 8:
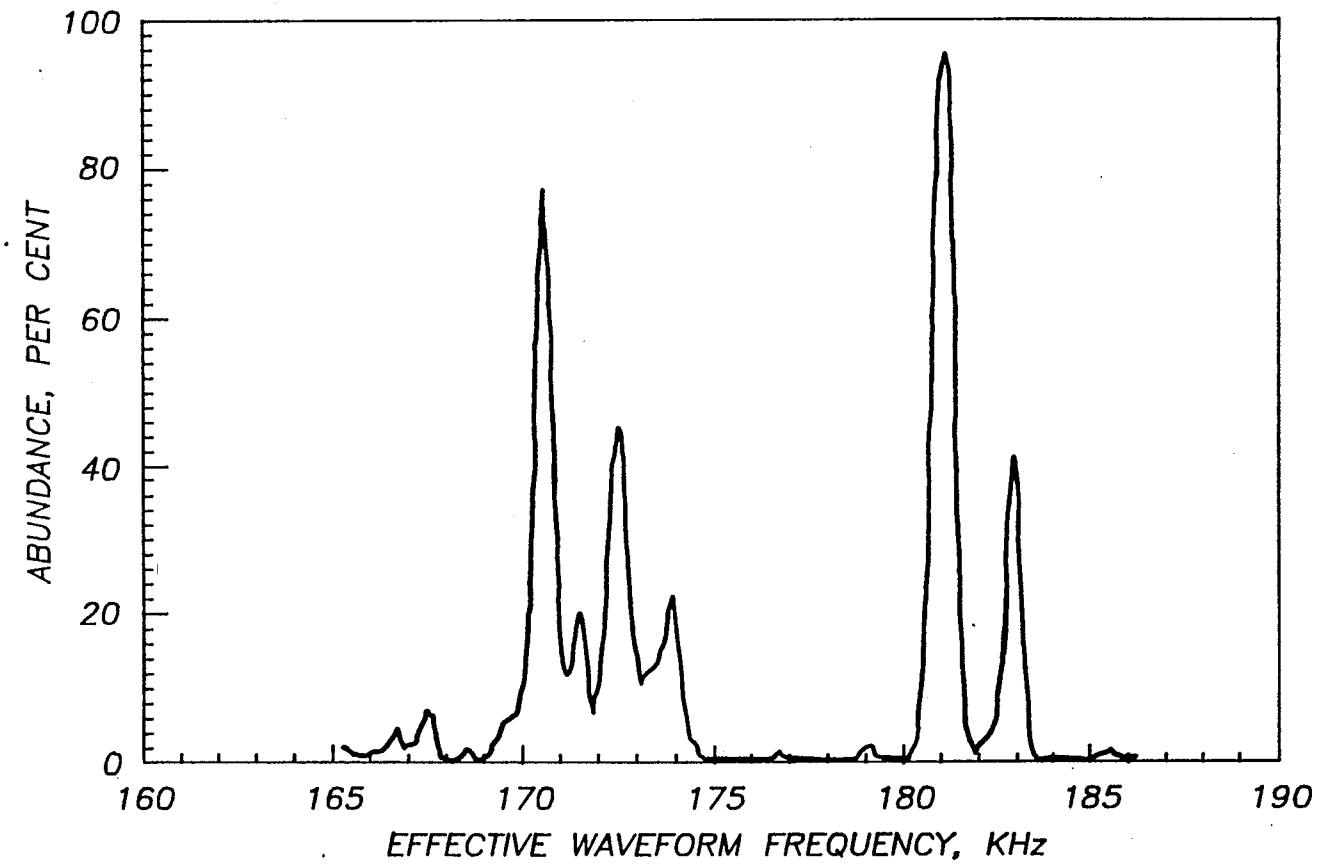
FIG. 8 is similar to FIG. 7 but differs in the "seed number" that was used to generate the series of random numbers; this Figure illustrates the variability that is encountered with different sequences of random numbers.

FIG. 7 and FIG. 8 are ejection efficiency frequency spectra obtained with noise waveforms according to Kelley (gaussian noise, 131072 points). The two waveforms differ in the "seed number" that was used to generate the series of random numbers, and illustrate the difference that is encountered with different sequences of random numbers. These spectra illustrate the poor spectral coverage of noise waveforms. When waveforms such as these are used to exclude ions from the trap, some ions are efficiently ejected while others, with resonance frequencies near a hole, are not ejected at all.

Noise waveforms may also be calculated using the SWIFT technique. The magnitude part of the frequency spectrum is set to a constant (within the frequency band of interest, but zero outside of the band) and the phase part of the frequency spectrum is assigned using random numbers (a technique commonly called phase randomization). Of course, if the distribution of the random numbers has a sufficiently small variance, the resulting time domain waveform will be essentially a pulse, as would be obtained with a constant phase. However, larger variances produce time domain waveforms that appear similar to waveforms computed by directly using random numbers to assign the time domain waveform itself. The spectral coverage of such SWIFT waveforms is similarly poor and ejection efficiency frequency spectra obtained using them are qualitatively similar to FIGS. 7 and 8.

To summarize the necessary characteristics of a waveform used for the ejection of ions during ionization, the waveform should ideally have a practically realizable dynamic range, good temporal spectral homogeneity, and good spectral coverage. The waveforms calculated according to the methods of the prior art do not meet all three requirements. In particular, SWIFT waveforms (from a quadratic phase assignment) show good spectral coverage, but poor spectral homogeneity while noise waveforms show good spectral homogeneity but poor spectral coverage. Of course, any possible waveform may be calculated using an inverse FT, but that theoretical possibility is of little use in actually creating waveforms, except in those cases where a procedure can be defined for assigning the phase spectrum.

Two considerations from Fourier theory indicate limits to the achievable characteristics of digitally produced waveforms. The first is the well-known Gibb's phenomenon (or Gibb's oscillation) in which a rapid change in the phase part of the frequency spectrum (a phase discontinuity) results in a waveform (after the inverse FT) that does not have a true magnitude frequency spectrum that matches the magnitude frequency spectrum that was used in the calculation. Thus, as illustrated by Marshall et al., if one uses a band of constant amplitude for a magnitude spectrum and a table of random numbers for the phase spectrum, the frequency spectrum of the resulting time domain waveform is not a band of constant amplitude, but rather a band of almost random amplitude. Simply performing the inverse discrete Fourier transform, followed by the forward Fourier transform on the same data set will not show the randomness in the magnitude frequency spectrum. Marshall et al. used zero-filling on the time domain data set before performing the forward transform. The wildly varying magnitudes observed in this way are physically real and are not an artifact of the calculation. To summarize, it is not possible to simultaneously maintain a constant magnitude frequency spectrum and a rapidly varying or randomized phase spectrum.

The other consideration from Fourier theory relates to the consequence of a smoothly varying phase frequency spectrum. Marshall et al. apparently discovered the usefulness of the quadratic phase function by empirical means. Later, Guan elegantly showed that this function in fact yields a time domain waveform of optimally reduced dynamic range (J. Chem. Phys. 91 (2) 775 (1989)). Guan based his argument on the "time-shifting theorem" of Fourier analysis which states that for a linearly varying phase as a function of frequency, the wave packet is shifted in the time domain by an amount proportional to the slope of the linear relation. A constant magnitude frequency spectrum may be divided into a series of magnitude frequency spectra, each with an associated phase slope. For a quadratically varying phase, the slope of the phase varies linearly with frequency so each of the spectrum parts is linearly shifted in time. This results in the frequency-sweep character of the total, time domain waveform. Importantly, by extension any smoothly varying phase function will lead to poor temporal spectral homogeneity, because of the association of frequency with time-shifting.

The two considerations from Fourier theory together imply that a waveform with a true, constant magnitude frequency spectrum cannot also have good temporal spectral homogeneity. Because of this, we investigated a different type of waveform, the comb waveform, in which the magnitude frequency spectrum is a series of discrete peaks, rather than a flat band. We calculate the comb by summing a series of sine functions of equally spaced frequency; each point in the waveform is calculated by summing a series of sines that contains a term for each frequency component in the desired frequency spectrum. As with the SWIFT waveform, the phase cannot remain constant because of dynamic range considerations. Our preferred method of assigning the phase is a quadratic variation with frequency, as with Marshall's method. The coarseness of the frequency spacing results in a series of closely spaced peaks in the ejection efficiency spectrum, but the difference in height between the peaks and the valleys is sufficiently small that, in practice, there are no holes and ions are ejected with a relatively uniform efficiency throughout the frequency range. Experience has shown that in actual practice comb waveforms are effective at efficiently ejecting all ions with masses within a band, while allowing reasonably good ejection resolution at the edge of the band or in a notch in the band.

The specific calculation is as follows:

$$v(t) = S_c \sum_{i=0}^{i=n-1} \sin[(f_s + if_d)t) + p_r(f_s + if_d - f_0)^2]$$

where v(t) is the voltage at time t, $S_c$ is a normalization factor (or gain) to scale the voltage to a value that the system can produce, and that causes ejection in the desired time interval, n is the number of discrete frequencies to be added, $f_s$ is the smallest frequency, $f_d$ is the frequency interval between successive frequencies, $p_r$ is the "phase rotation factor", and $f_0$ is the frequency at which the phase is at a minimum or maximum.

Figure 11:
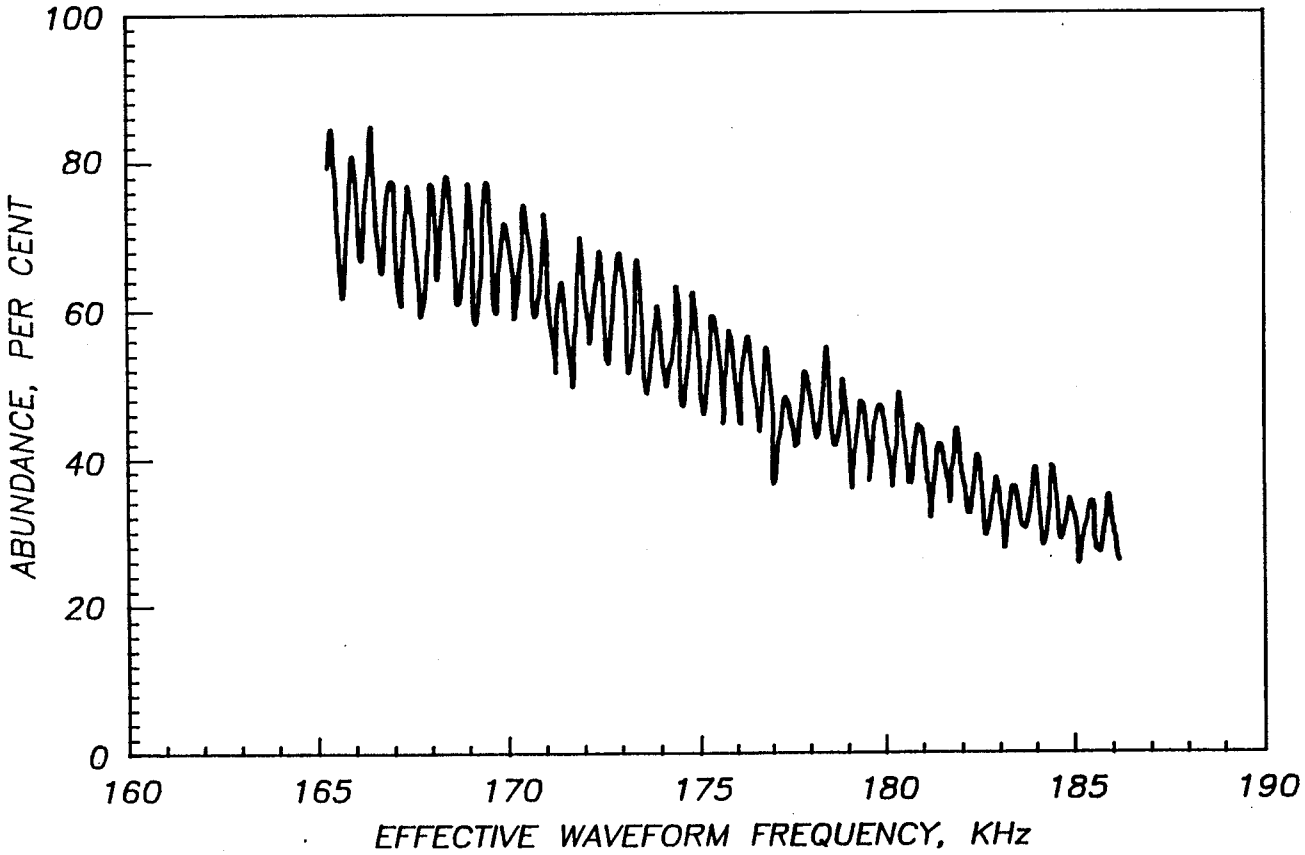
FIG. 11 is an ejection efficiency frequency spectrum obtained with a waveform calculated according to the invention.

The waveforms used to acquire the ejection efficiency spectra of FIGS. 8 and 9 were typical. The frequencies spanned from 5 kHz to 500 kHz and $f_d$ was 0.5 kHz. The most critical parameter was the phase rotation factor (which must be based on the value of $f_d$). In FIG. 11 the phase rotation factor was chosen so that $$p_r(0.427KHz)^2 = 2\pi$$

That is, the first complete phase rotation at the phase extremum requires a little less than the interval between the frequencies themselves. If the phase rotation factor is improperly chosen, the calculated waveform will show undesirable beats in the time domain so that power is not evenly distributed at all times. Slight changes in the phase rotation factor may cause large (and often undesirable) changes in the time domain of the waveform.

Figure 9A:
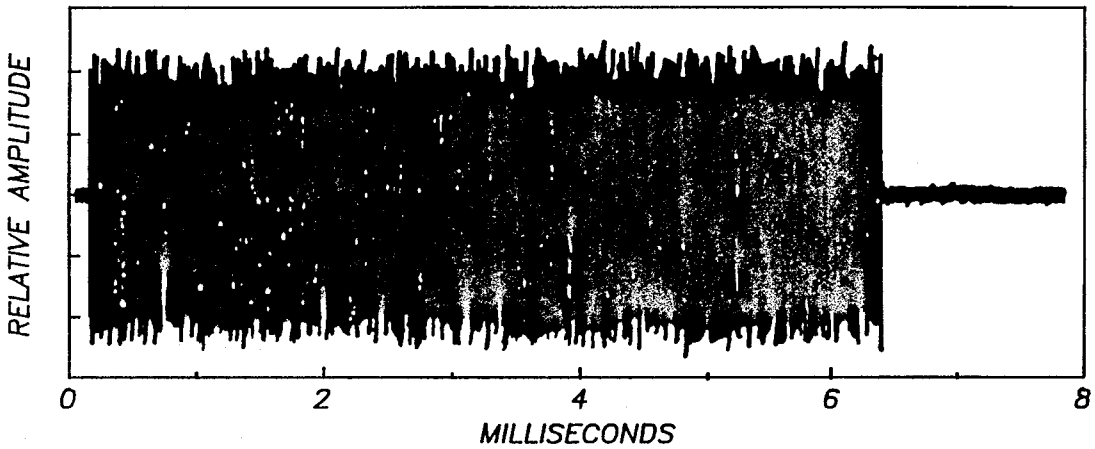
FIG. 9 shows the observed time domain of a waveform calculated according to this invention (FIG. 9*a*) and the observed magnitude part of the frequency domain (FIG. 9*b*). This Figure is intended for comparison with FIG. 2.
Figure 9B:
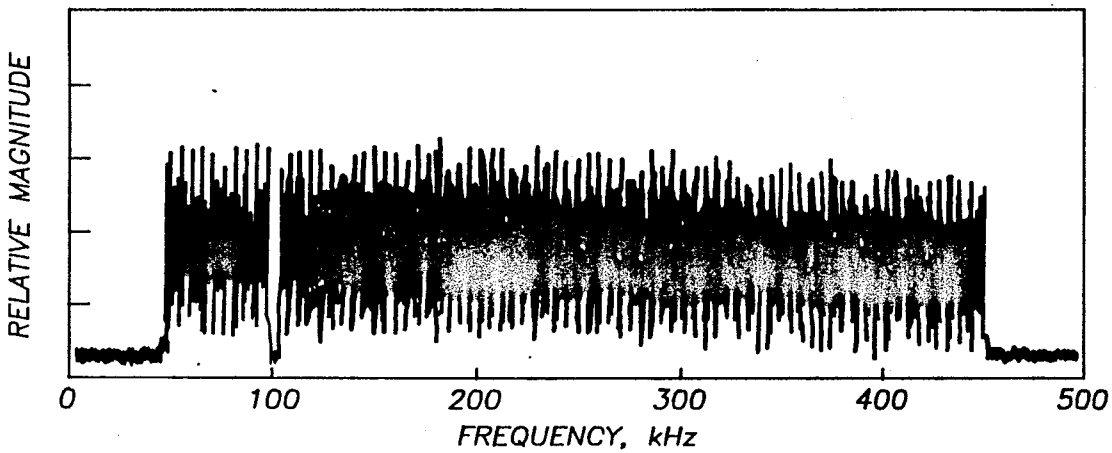
Figure 10A:
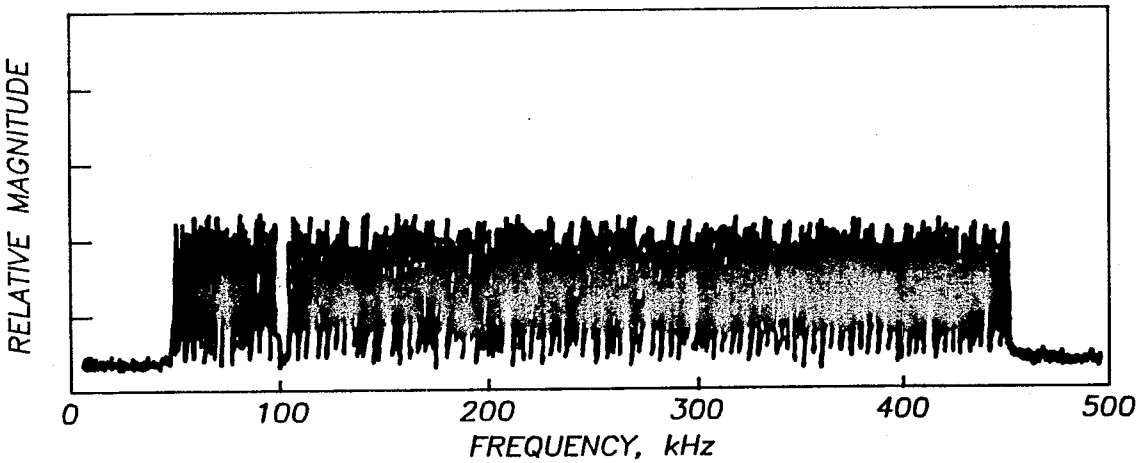
FIG. 10 shows a variation on the experiment shown in FIG. 9 in which the second half of the time domain is removed (FIG. 10*a*) and the first half of the time domain is removed (FIG. 10*b*) by electronically gating the waveform to zero during half of the time domain period. The frequency spectra for the two halves of the time domain are essentially the same, in marked contrast to the similar experiment for the SWIFT waveform (shown in FIG. 3).
Figure 10B:
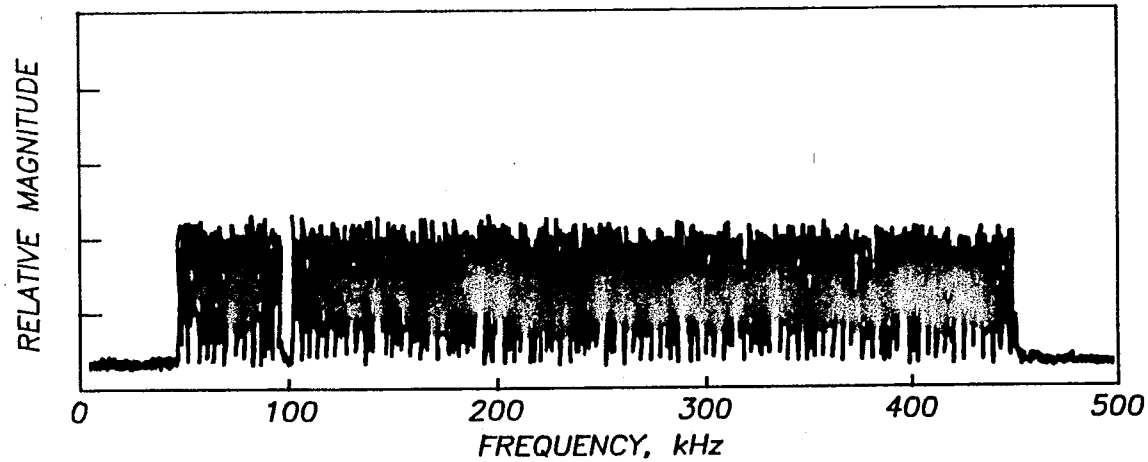

Notches may be entered into a comb-type waveform by either summing two comb waveforms of non-overlapping frequency content or by omitting from the calculation of a comb those frequencies that are not to be excited. FIG. 9 shows the observed time domain of a waveform calculated according to the present invention (FIG. 9*a*) and the observed magnitude part of the frequency domain (FIG. 9*b*). In this case the comb was generated by omitting a band of frequencies from the calculation. This Figure should be compared with FIG. 2, in which a SWIFT waveform is shown. Figure 10 shows a variation on the experiment shown in FIG. 9 in which the second half of the time domain is removed (FIG. 10*a*) and in which the first half of the time domain is removed (FIG. 10*b*) by electronically gating the waveform to zero during half of the time domain period. The frequency spectra for the two halves of the time domain are essentially the same, in contrast to the corresponding results for a SWIFT waveform shown in FIG. 3. The waveform of FIG. 9 does not otherwise show the characteristics of a scanned waveform and therefore shows good temporal spectral homogeneity.

Figure 12:
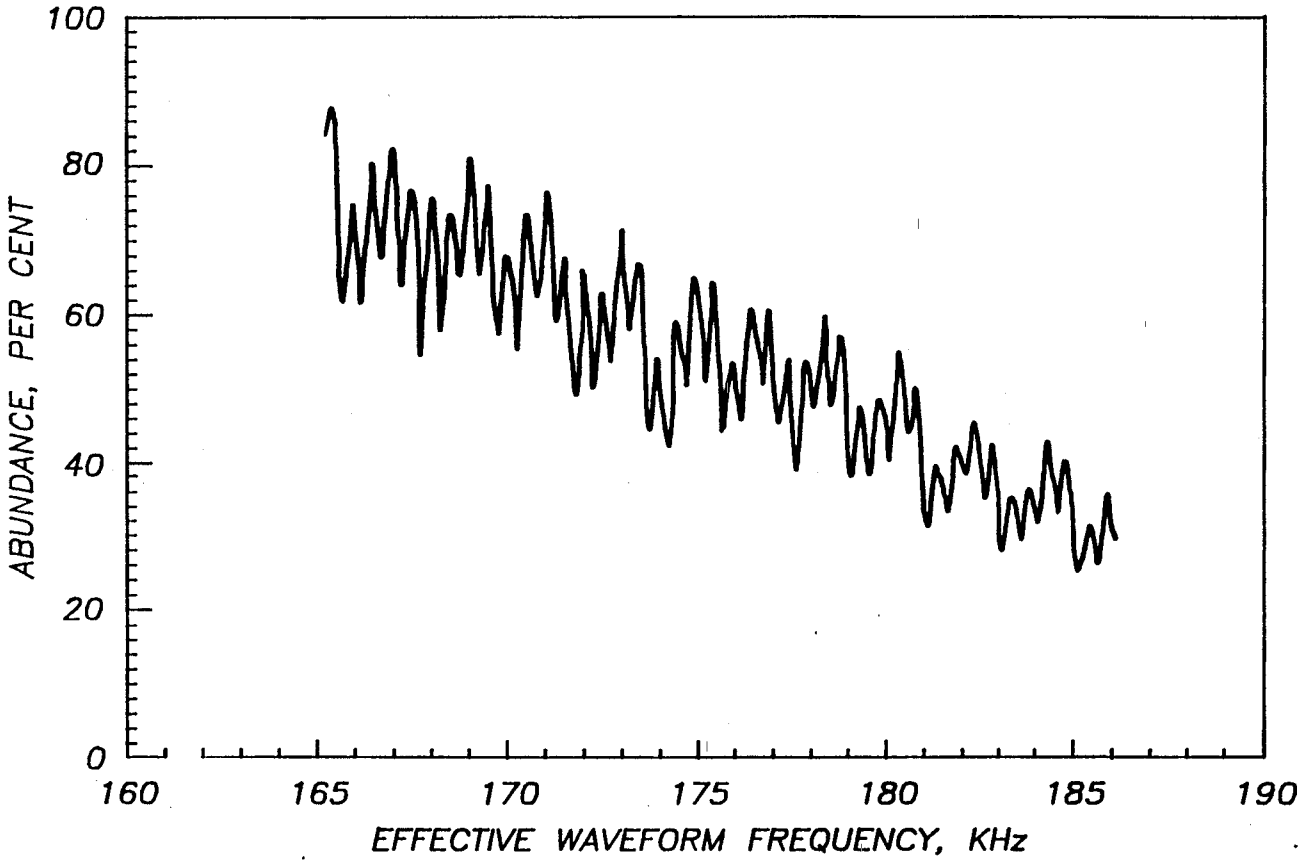
FIG. 12 is another ejection efficiency frequency spectrum obtained with a waveform calculated according to the invention.

FIGS. 11 and 12 show ejection efficiency frequency spectra obtained with two similar waveforms calculated according to the present invention. While the ejection efficiency does vary somewhat with frequency, the variation is not nearly as pronounced as that obtained with noise waveforms (such as FIGS. 7 and 8). Also, spectral analysis of small time intervals within the time domain shows that the frequency content of the waveform does not vary with the randomness found in noise waveforms. Thus if a waveform such as that of FIG. 9 were used for ion ejection during the ionization period, ions formed late in the ionization period would experience an excitation voltage with much the same frequency content as would ions formed early in the ionization period. The waveform of the present invention is therefore superior (for this application) because the frequency content does not vary systematically as with the SWIFT waveform calculated with a quadratic phase function and does not vary in the random fashion of the noise waveforms.

Figure 13A:
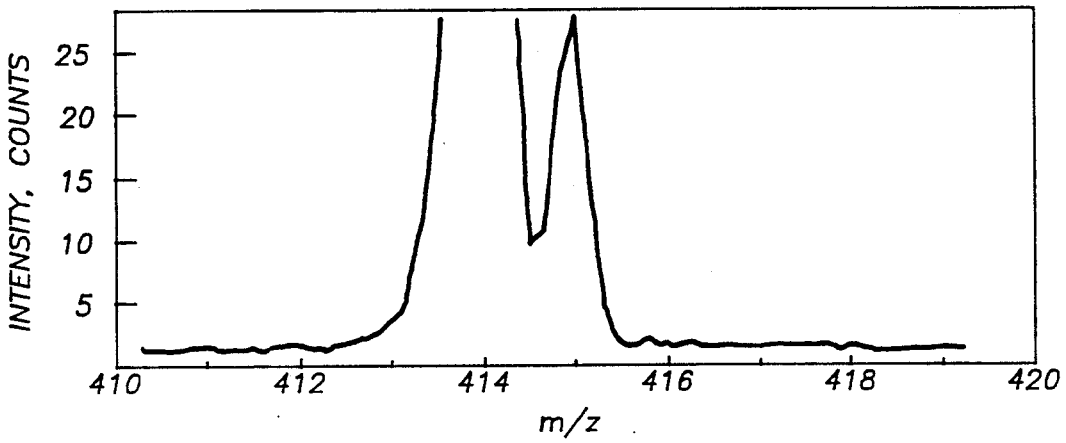
FIG. 13 shows a comparison of part of the mass spectrum obtained with no waveform being applied during the ionization period (FIG. 13*a*) and the mass spectrum obtained by application during the ionization interval of the waveform of the invention (FIG. 13*b*). The ionization period in FIG. 13*a* was 0.6 ms and the abundant ions of m/z 414 and m/z 415 prevented the storage of ions of m/z 416; the ionization period in FIG. 13*b* was 25 ms and the waveform ejected ions of m/z 414 and m/z 415 as they were formed during ionization so that ions of m/z 416 could be accumulated without space charge being present.
Figure 13B:
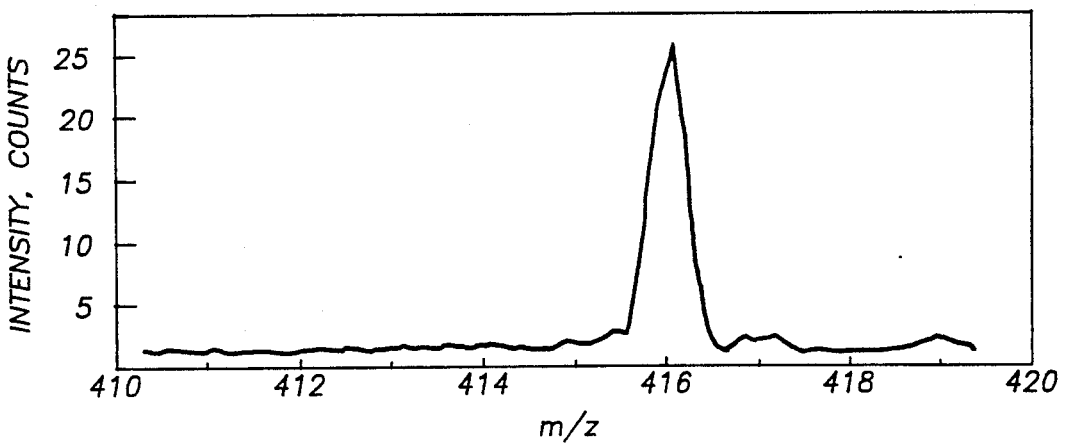

A practical use of a waveform of the type of the present invention is shown in FIG. 13, in which the accumulation of an ion of interest is made possible, even though much more abundant ions are present. A mass spectrum obtained with no waveform being applied during the ionization period (FIG. 13*a*) is compared to the mass spectrum obtained by application during the ionization interval of the waveform (FIG. 13*b*); the ionization period in FIG. 13*a* was 0.6 ms and the abundant ions of m/z 414 and m/z 415 (and also ions of smaller m/z, not shown) prevented storage of the ions of interest, m/z 416. By using the waveform during ionization, a much longer ionization period of 25 ms can be used without filling the trap with the abundant ions of m/z 414 and m/z 415 (and ions of smaller m/z).

Figures 14A, 14B, 14C:
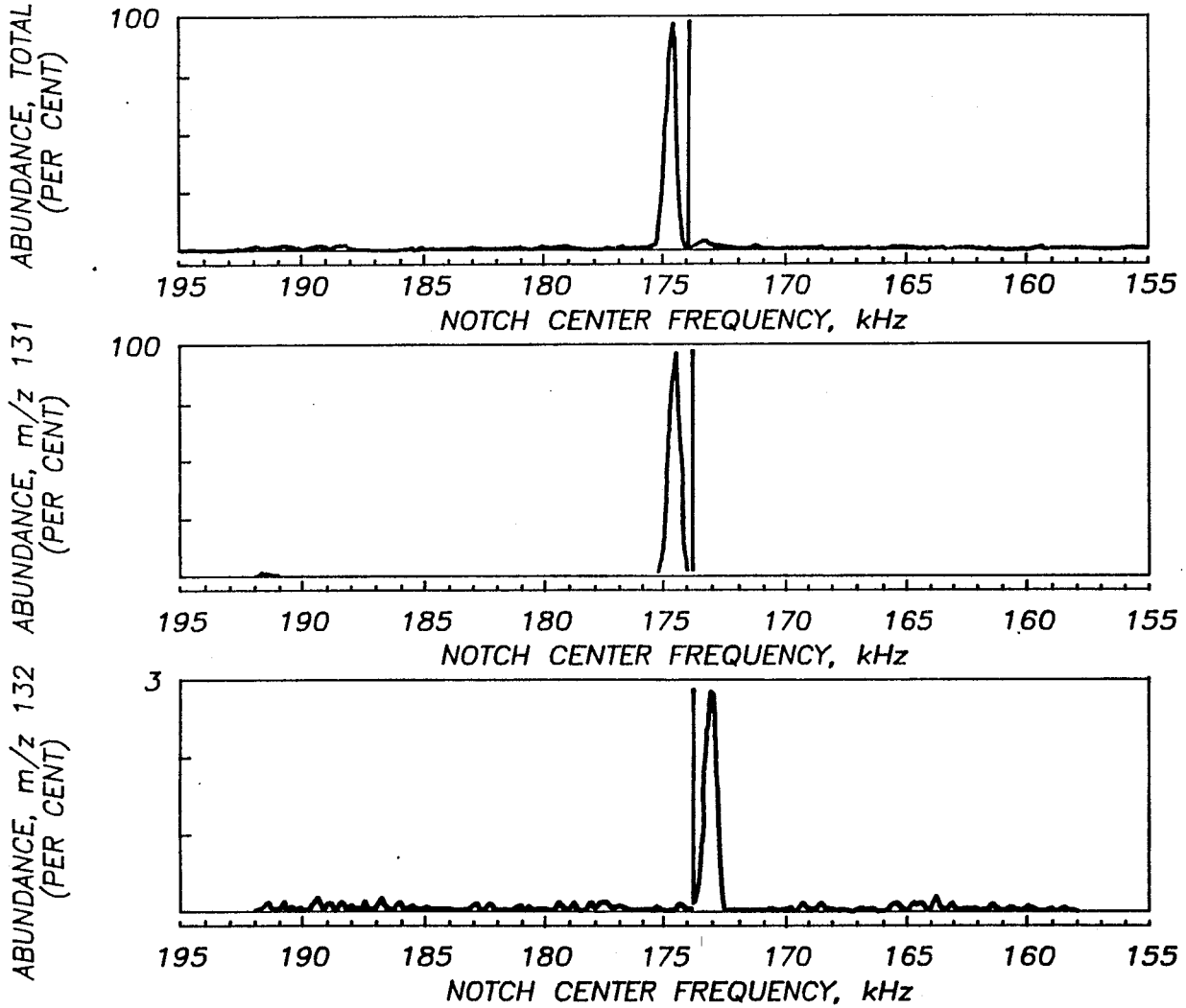
FIG. 14*a* shows a plot of the total ion abundance after application of the waveform.
FIG. 14*b* shows the abundance of m/z 131 after application of the waveform.
FIG. 14*c* shows the abundance of m/z 132 after application of the waveform.

Since the spectral coverage for the waveforms of the present invention is somewhat uneven (as seen in the ejection efficiency frequency spectra of FIGS. 11 and 12), the ability to discriminate between ions of adjacent m/z values (and therefore close frequencies) is likely to be inferior to that shown by SWIFT waveforms, which have been used to separate ions of the same nominal mass but different exact masses. However, the waveforms of the present invention can be used to separate ions of a given m/z value from those of an adjacent m/z value. For example, FIG. 14 shows three ejection efficiency frequency spectra obtained using a waveform calculated according to the present invention. Unlike the ejection efficiency frequency spectra of the preceding figures, the waveform was applied during ionization so that ions with a range of m/z values were present during the application of the waveform (as would be the case when the waveform is used during ionization). FIG. 14*a* shows a plot of the total ion abundance after the application of the waveform, FIG. 14*b* shows the abundance of m/z 131 after the application of the waveform, and FIG. 14*c* shows the abundance of m/z 132 after the application of the waveform. Clearly, the proper selection of the center frequency of the notch allows m/z 131 to trapped, while m/z 132 is ejected or allows m/z 132 to be trapped while m/z 131 is excluded. FIG. 14*a*, the total ion abundance, has the appearance of a mass spectrum with unit resolution, which indicates that the notch itself has a resolution of about 1 m/z unit.

In the calculation of the comb waveform, a critical characteristic is the difference in frequency between adjacent frequency components (or "tines"). Since the discrete inverse Fourier transform is calculated as a sum of equally spaced cosine terms, the comb waveform becomes similar to the SWIFT waveforms (calculated using a band for the magnitude frequency spectrum) when the tines are closely spaced. The frequency spacing produced by the discrete Fourier transform is $1/N\Delta$, where N is the number of points (in the time domain) and $\Delta$ is the sampling interval and the product $N\Delta$ is the duration of the time domain waveform. We find that the difference in spacing between adjacent frequencies in a comb waveform should generally be greater than about four times the reciprocal of the duration of the time domain waveform to achieve adequate temporal spectral homogeneity, but a frequency spacing of as little as two times the reciprocal of the duration of the time domain waveform has given adequate temporal spectral homogeneity in specific applications.

A comb waveform can also be calculated by using the algorithm for the inverse Fourier transform, by assigning the magnitude frequency spectrum as properly spaced frequency components (rather than assigning all the frequencies within the band to be ejected to some constant value, as is done in the prior art). Another method of performing the calculation is to generate a comb waveform that covers the entire range of frequencies that ions may have (so that all ions would be ejected by the application of this waveform), and then tailoring this waveform to each experiment using digital or analog filtering techniques.

The tines of the comb need not be evenly spaced. Since the ion m/z values are spaced at integral values and because of the (approximately) inverse relationship between the ion resonant frequencies and their m/z values, the ion resonant frequencies are not evenly spaced. A waveform can be calculated in which discrete frequencies that correspond to the ion frequencies are used.

Although the invention has been illustrated and described in connection with a Paul ion trap, it may apply to analogous structures such as ion cyclotron resonance instruments, all of which use an ambient magnetic field. The comb waveform can be applied to the excitation electrodes of the ion cyclotron resonance cell.

What is claimed:

1. An ion trap mass spectrometer apparatus comprising:

an ion trap having a plurality of electrodes, means for establishing ion trapping fields within said ion trap for trapping ions over a predetermined mass range, ion excitation means for resonantly ejecting ions trapped in said ion trap including:

means for determining a plurality of spaced discrete frequencies covering the range of frequencies of the characteristic motion of ions which are to be resonantly ejected from the ion trap, means for processing said discrete frequencies to generate a plurality of time dependent voltage amplitude values which vary throughout the time domain such that the frequency content of said time dependent voltage amplitude values is relatively uniform over the entire time domain, and such that the magnitude of the discrete frequencies is relatively uniform over the frequency domain, and means for applying said time dependent voltage amplitude values to said ion trap electrodes whereby to resonantly eject said ions.

2. An ion trap mass spectrometer apparatus as in claim 1 wherein said frequencies are equally spaced.

3. An ion trap mass spectrometer apparatus as in claim 1 wherein said frequencies are unequally spaced.

4. An ion trap mass spectrometer apparatus as in claim 1 wherein said plurality of spaced discrete frequencies have phases such that the frequency components are not in phase at any one point.

5. An ion trap mass spectrometer apparatus as in claim 4 wherein said phases are varied non-linearly with frequency.

6. An ion trap mass spectrometer apparatus as in claim 4 wherein said phases are varied quadratically with frequency.

7. An ion trap mass spectrometer apparatus as in claim 1 wherein one or more of said discrete frequencies are removed from said range of frequencies of the characteristic motion of ions whereby ions having characteristic motion at said frequencies are not resonantly ejected.

8. An ion trap mass spectrometer apparatus as in claim 1 wherein one or more of said discrete frequencies are removed from said plurality of time dependent voltage amplitude values whereby ions have corresponding characteristic frequencies of motion are not resonantly ejected.

9. An ion trap mass spectrometer apparatus as in claim 1 wherein said plurality of spaced discrete frequencies cover two or more separated ranges of frequencies corresponding to the characteristic frequencies of motion of two or more discrete m/z ranges of ions to be resonantly ejected, and being separated by frequency gaps or notches which correspond to the characteristic frequencies of motion of ions which are not to be resonantly ejected, but are to be accumulated within said apparatus.

10. A method for resonantly ejecting ions stored in an ion trap comprising the steps of determining a plurality of spaced discrete frequencies covering the range of frequencies of characteristic motion of the ions which are to be resonantly ejected, processing said discrete frequencies to generate a plurality of time dependent voltage amplitude values which vary throughout the time domain such that the frequency content of said time dependent voltage amplitude values is relatively uniform over the entire time domain, and such that the magnitude of the discrete frequencies is relatively uniform over the frequency domain, and applying said time dependent voltage amplitude values to said ion trap electrodes whereby to resonantly eject said ions.

11. A method for resonantly ejecting ions from an ion trap as in claim 10 wherein one or more of said discrete frequencies are removed from said range of frequencies of the characteristic motion of ions, whereby ions having characteristic motion at said frequencies are not ejected.

12. A method for resonantly ejecting ions from an ion trap as in claim 10 wherein one or more of said discrete frequencies are removed from said plurality of time dependent voltage amplitude values whereby ions having corresponding characteristic frequencies of motion are not ejected.

13. A method for resonantly ejecting ions from an ion trap as in claim 10 wherein said plurality of spaced discrete frequencies cover two or more separated ranges of frequencies corresponding to the characteristic frequencies of motion of two or more discrete m/z ranges of ions to be resonantly ejected, and being separated by frequency gaps or notches which correspond to the characteristic frequencies of motion of ions which are not to be resonantly ejected, but are to be accumulated within the ion trap.

14. A method for resonantly ejecting ions stored in the ion trap of a mass spectrometer which stores ions over a predetermined mass range including the steps of:

determining a series of spaced sine functions which have phases that vary non-linearly with frequency, said sine functions covering the range of frequencies of the characteristic motion of ions to be ejected, summing the series of sine functions to provide a waveform which has a series of closely spaced discretely separated peaks in the frequency domain, such that the difference in ejection efficiency between an ion having a characteristic frequency of motion which coincides with a discrete frequency component of the waveform, and an ion having a characteristic frequency of motion which falls between the discrete frequency components of the waveform is small, and applying said waveform to the ion trap to resonantly eject selected ions.

15. A method for resonantly ejecting ions stored in an ion trap including the steps of:

determining a series of spaced sine functions which have phases that vary non-linearly with frequency, said sine functions covering the range of frequencies of the characteristic motion of ions to be ejected, summing the series of sine functions to provide a waveform which has a series of spaced discretely separated peaks in the frequency domain, such that the difference in frequencies between successive discretely separated peaks in the frequency domain is at least four times the reciprocal of the time interval over which the waveform is to be applied, and applying said waveform to the ion trap to resonantly eject selected ions.

16. A method for resonantly ejecting ions stored in an ion trap including the steps of:

determining a series of spaced sine functions which have phases that vary non-linearly with frequency, said sine functions covering the range of frequencies of the characteristic motion of ions to be ejected, summing the series of sine functions to provide a waveform which has a series of spaced discretely separated peaks in the frequency domain, such that the difference in frequencies between successive discretely separated peaks in the frequency domain is at least two times the reciprocal of the time interval over which the waveform is to be applied, and applying said waveform to the ion trap to resonantly eject selected ions.

17. The method of claim 15 wherein before applying said waveform to the ion trap the waveform is subjected to a digital filter to alter the frequency spectrum of the waveform.

18. The method of claim 16 wherein before applying said waveform to the ion trap the waveform is subjected to a digital filter to alter the frequency spectrum of the waveform.

19. The method of claim 15 wherein the waveform is subjected to an analog filter at the time of applying said waveform to the ion trap to alter the frequency spectrum of the waveform.

20. The method of claim 16 wherein the waveform is subjected to an analog filter at the time of applying said waveform to the ion trap to alter the frequency spectrum of the waveform.

21. A method for resonantly ejecting ions stored in an ion trap including the steps of:

calculating a waveform in which the magnitude part of the frequency spectrum is assigned in such a way that the frequency spectrum substantially consists of a series of discretely separated peaks covering a range of frequencies corresponding to the characteristic frequencies of ions to be ejected and in which the phase part of the frequency spectrum is assigned as a nonlinear function of frequency and in which the time domain waveform is calculated by application of the inverse Fourier transform, and applying said waveform to the ion trap to resonantly eject selected ions.

22. A method for resonantly ejecting ions stored in an ion trap including the steps of:

calculating a waveform in which the magnitude part of the frequency spectrum is assigned in such a way that the frequency spectrum substantially consists of a series of discretely separated peaks covering a range of frequencies corresponding to the characteristic frequencies of ions to be ejected and such that the difference in frequencies between the successive peaks in the frequency domain is at least four times the reciprocal of the time interval over which the waveform is to be applied, and in which the phase part of the frequency spectrum is assigned as a nonlinear function of frequency and in which the time domain waveform is calculated by application of the inverse Fourier transform, and applying said waveform to the ion trap to resonantly eject selected ions.

23. A method for resonantly ejecting ions stored in an ion trap including the steps of:

calculating a waveform in which the magnitude part of the frequency spectrum is assigned in such a way that the frequency spectrum substantially consists of a series of discretely separated peaks covering a range of frequencies corresponding to the characteristic frequencies of ions to be ejected and such that the difference in frequencies between the successive peaks in the frequency domain is at least two times the reciprocal of the time interval over which the waveform is to be applied, and in which the phase part of the frequency spectrum is assigned as a nonlinear function of frequency and in which the time domain waveform is calculated by application of the inverse Fourier transform, and applying said waveform to the ion trap to resonantly eject selected ions.

24. A method for resonantly ejecting ions stored in an ion trap including the steps of:

calculating a waveform in which the magnitude part of the frequency spectrum is substantially a series of discretely separated peaks covering a range of frequencies corresponding to the characteristic frequencies of ions to be ejected, and applying said waveform to the ion trap to resonantly eject selected ions.

25. A method for resonantly ejecting ions stored in an ion trap including the steps of:

calculating a waveform in which the magnitude part of the frequency spectrum substantially consists of a series of discretely separated peaks covering a range of frequencies corresponding to the characteristic frequencies of ions to be ejected and such that the difference in frequencies between the successive peaks in the frequency domain is at least four times the reciprocal of the time interval over which the waveform is to be applied, and p1 applying said waveform to the ion trap to resonantly eject selected ions.

26. A method for resonantly ejecting ions stored in an ion trap including the steps of:

calculating a waveform in which the magnitude part of the frequency spectrum substantially consists of a series of discretely separated peaks covering a range of frequencies corresponding to the characteristic frequencies of ions to be ejected and such that the difference in frequencies between the successive peaks in the frequency domain is at least two times the reciprocal of the time interval over which the waveform is to be applied, and applying said waveform to the ion trap to resonantly eject selected ions.

* * * * *